US009250602B2

(12) United States Patent
Tomatsu et al.

(10) Patent No.: US 9,250,602 B2
(45) Date of Patent: Feb. 2, 2016

(54) IMAGE FORMING APPARATUS

(71) Applicant: Brother Kogyo Kabushiki Kaisha, Nagoya (JP)

(72) Inventors: Yoshiya Tomatsu, Kasugai (JP); Makoto Souda, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 14/339,550

(22) Filed: Jul. 24, 2014

(65) Prior Publication Data

US 2015/0093145 A1 Apr. 2, 2015

(30) Foreign Application Priority Data

Sep. 30, 2013 (JP) ..... 2013-204678

(51) Int. Cl.
*G03G 21/16* (2006.01)
*G03G 21/18* (2006.01)

(52) U.S. Cl.
CPC ..... *G03G 21/1676* (2013.01); *G03G 21/1633* (2013.01); *G03G 21/16* (2013.01); *G03G 21/1619* (2013.01); *G03G 21/1647* (2013.01); *G03G 21/1853* (2013.01); *G03G 2215/0119* (2013.01); *G03G 2221/1654* (2013.01); *G03G 2221/1684* (2013.01)

(58) Field of Classification Search
CPC ..... G03G 21/16
USPC ..... 399/110
See application file for complete search history.

(56) References Cited

U.S. PATENT DOCUMENTS

| | | | | |
|---|---|---|---|---|
| 2007/0147887 | A1 | 6/2007 | Hattori | |
| 2010/0272470 | A1 | 10/2010 | Tomatsu et al. | |
| 2011/0052254 | A1* | 3/2011 | Hashimoto | 399/110 |
| 2011/0211862 | A1* | 9/2011 | Yonemoto | 399/110 |
| 2013/0084105 | A1 | 4/2013 | Suzuki | |

FOREIGN PATENT DOCUMENTS

| | | | |
|---|---|---|---|
| JP | 2007-178656 | A | 7/2007 |
| JP | 2010-256766 | A | 11/2010 |
| JP | 2011-070154 | A | 4/2011 |
| JP | 2013-073221 | A | 4/2013 |

* cited by examiner

*Primary Examiner* — Clayton E Laballe
*Assistant Examiner* — Kevin Butler
(74) *Attorney, Agent, or Firm* — Burr & Brown, PLLC

(57) ABSTRACT

An image forming apparatus has a housing. Inside the housing, there are provided an image carrying member, a developing unit, a driving force transmission unit, a contact/separation mechanism, a transmission enable/disable mechanism, a cover movably supported by the housing, and a single link member configured to move in association with an opening/closing movement of the cover. When the link member moves in association with the opening movement of the cover, the contact/separation mechanism moves the developing unit to a detachable position, and the transmission enable/disable mechanism moves the driving force transmission unit to the transmission cutoff position.

5 Claims, 12 Drawing Sheets

IMAGE FORMING APPARATUS

CROSS-REFERENCE TO RELATED APPLICATION

This application claims priority under 35 U.S.C. §119 from Japanese Patent Application No. 2013-204678 filed on Sep. 30, 2013. The entire subject matter of the application is incorporated herein by reference.

BACKGROUND

1. Technical Field

The following disclosure relates to an image forming apparatus.

2. Prior Art

Conventionally, there is known an image forming apparatus having a main body accommodating an image carrying member on which an electrostatic latent image is formed, a developing unit configured to apply toner to the electrostatic latent image to form a developed image (i.e., a toner image), and a moving mechanism configured to move the developing unit between a contact position where the developing unit contacts the image carrying member, and a spaced position where the developing unit is spaced from the image carrying member has been known. Typically, such a cover is provided to the image forming apparatus so as to open/close an opening formed on a surface of the main body. Such a cover is moved to the open position when the developing unit is removed from the main body.

In a conventional image forming apparatus as described above, a link mechanism is further employed. The link mechanism includes a plurality of link members and gear trains which are arranged between the cover and the moving mechanism. The link mechanism operates the moving mechanism in association with the opening movement of the cover member such that the developing unit is located at a removable position (i.e., the spaced position) so that the user can remove the developing unit from the main body.

It is also known another image forming apparatus which has a main body, an image carrying member, a developing unit, a driving force transmitting unit, a transmission enable/disable mechanism, a cover and a link member. The driving force transmitting mechanism transmits a driving force generated by a driving source to the image carrying member. The transmission enable/disable mechanism is configured to move the driving force transmitting mechanism between a transmission position allowing the driving force transmitting mechanism to transmit the driving force, and a cutoff position at which the transmission enable/disable mechanism prevents the driving force transmitting mechanism from transmitting the driving force to the image carrying member.

In this conventional apparatus, the link member moves in association with opening/closing movement of the cover. Specifically, the link member moves the transmission enable/disable mechanism in association with opening movement of the cover member such that the transmission enable/disable mechanism moves the driving force transmitting unit to the cutoff position. With this configuration, it becomes unnecessary to move the driving force transmitting mechanism to the transmission cutoff position separately from the cover opening operation, which improves operation for maintenance of the image forming apparatus.

SUMMARY

It is preferable that both the above-described configurations are employed in one image forming apparatus. In such a case, simply by opening the cover, the developing unit is moved to the removing position, and the driving force transmitting unit is moved to the transmission cutoff position. However, by employing the two mechanisms, the number of members increases, which results in increase of a manufacturing cost.

Aspects of disclosure relate an image forming apparatus in which operability for maintenance is improved with a combination of above-described functions, while the number of members of the combined function is reduced in comparison with a case where mechanisms realizing the above-described functions separately.

In one aspect of the disclosure, an image forming apparatus, which has a housing and an image carrying member arranged inside the housing. The image carrying member is configured such that an electrostatic latent image being formed on the image carrying member. The image forming apparatus further includes a developing unit detachably attached inside the housing, the developing unit being configured to supply toner to the image carrying member to develop the electrostatic latent image, a driving force transmission unit arranged inside the housing and configured to transmit a driving force from a driving source to the image carrying member, a contact/separation mechanism configured to move the developing unit between a contact position where the developing unit contacts the image carrying member and a separate position where the developing unit is separated from the image carrying member, a transmission enable/disable mechanism configured to move the driving force transmission unit between a transmission position at which the driving force transmission unit transmits the driving force to the image carrying member and a transmission cutoff position at which the driving force transmission unit does not transmit the driving force to the image carrying member, a cover movably supported by the housing so as to be opened and closed, the cover being opened when the developing unit is detached from the housing, and a single link member configured to move in association with an opening/closing movement of the cover.

It is noted that the single link member has a first active part connected to the contact/separation mechanism and a second active part connected to the transmission enable/disable mechanism. The first active part acts on the contact/separation mechanism as the link member moves in association with the opening movement of the cover such that the contact/separation mechanism moves the developing unit to a detachable position, which is one of the contact position and the separate position, and at which the developing unit is detachable from the housing. Further, the second active part acts on the transmission enable/disable mechanism as the link member moves in association with the opening movement of the cover such that the transmission enable/disable mechanism moves the driving force transmission unit to the transmission cutoff position.

BRIEF DESCRIPTION OF THE ACCOMPANYING DRAWINGS

The present disclosure is illustrated, and not limited, by way of example by the accompanying figures in which like reference numerals indicate similar elements.

Figure 10:
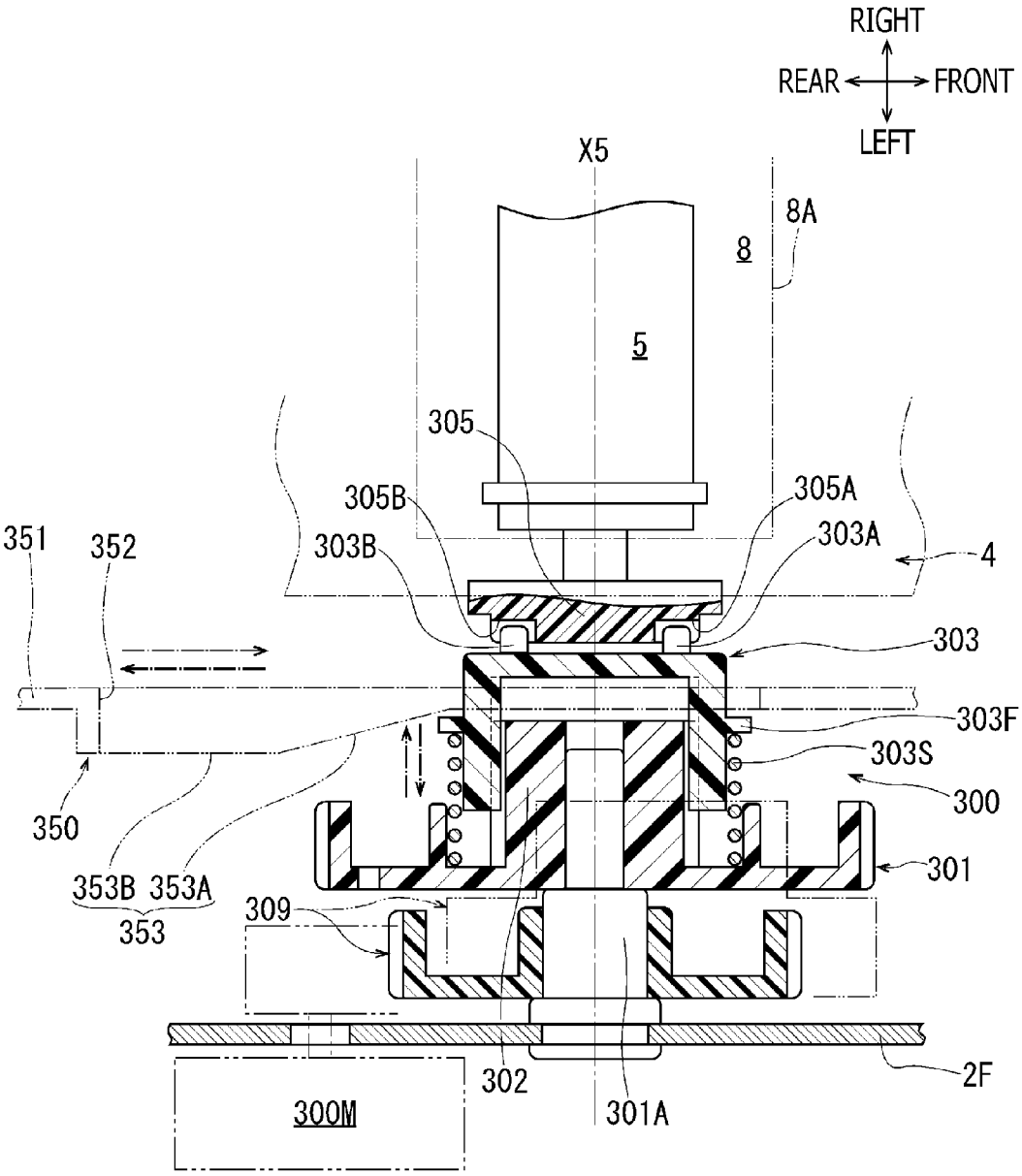

FIG. 10 schematically shows a transmission unit and the cutoff mechanism of the image forming apparatus according to the illustrative embodiment.

Figure 11B:
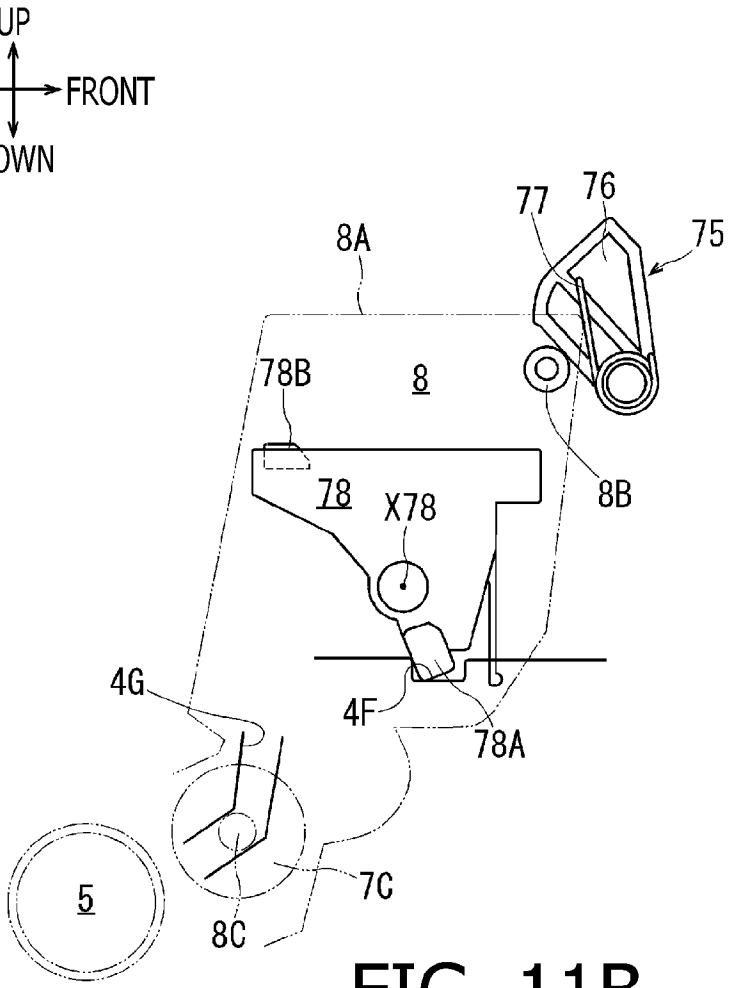
Figure 11A:
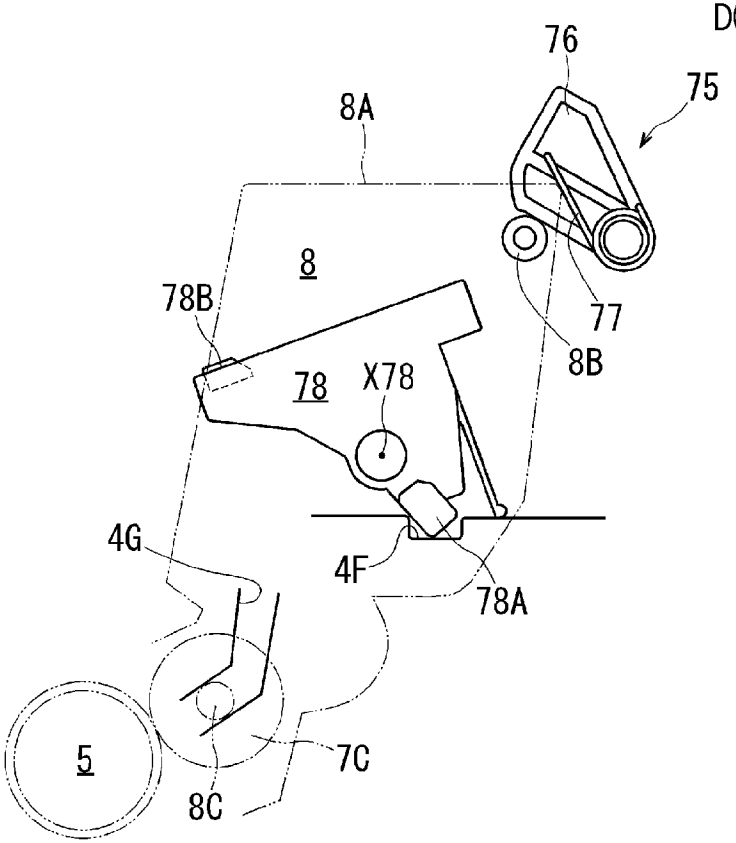

FIG. 11A schematically shows an image carrier, the developing unit located at an attached position, and the contact/separation mechanism according to the illustrative embodiment.

FIG. 11B schematically shows the image carrier, the developing unit located at a detached position, and the contact/separation mechanism according to the illustrative embodiment.

Figure 2:
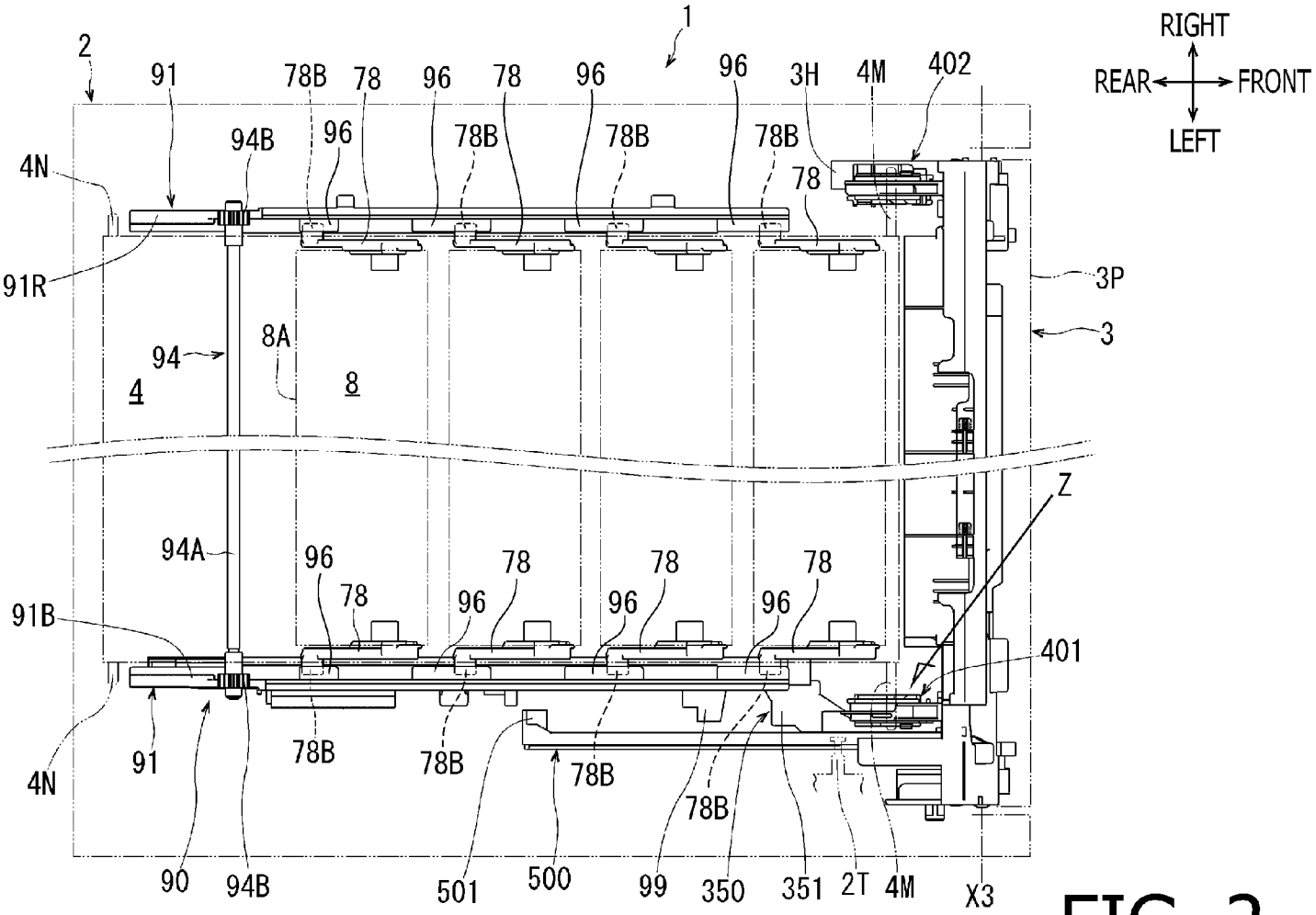
FIG. 2 is a plan view of a drawer, a developing unit, an contact/separation mechanism, a transmission enable/disable mechanism, a release mechanism, a cover and a link member of the image forming apparatus according to the illustrative embodiment.
Figure 12:
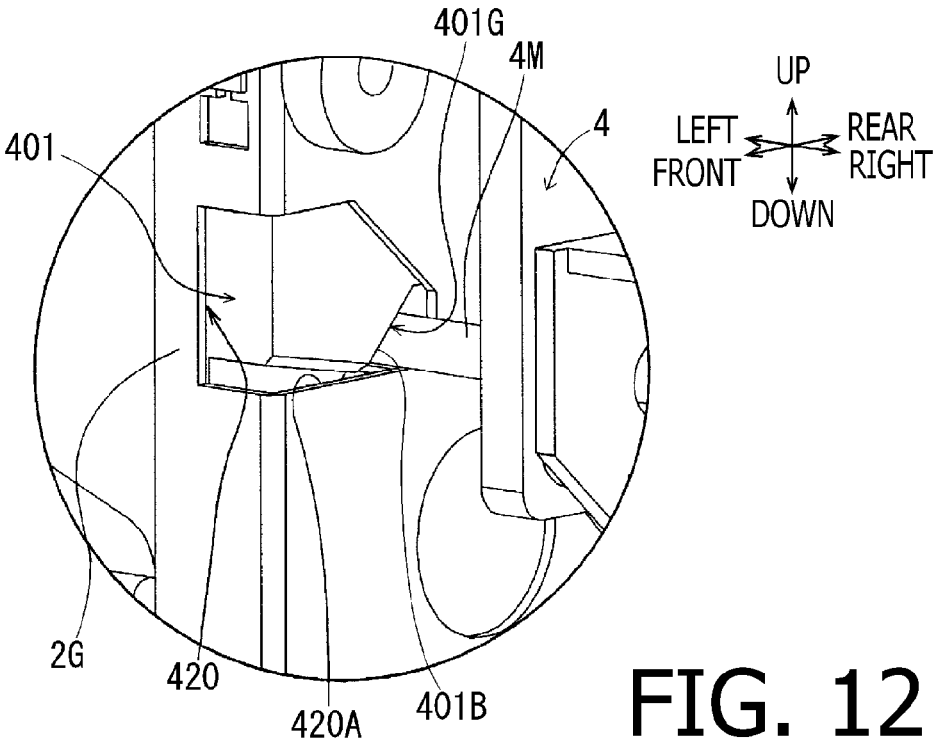

FIG. 12 is a partial perspective view, which is viewed along arrow Z in FIG. 2, showing the release mechanism located at a position.

Figure 9:
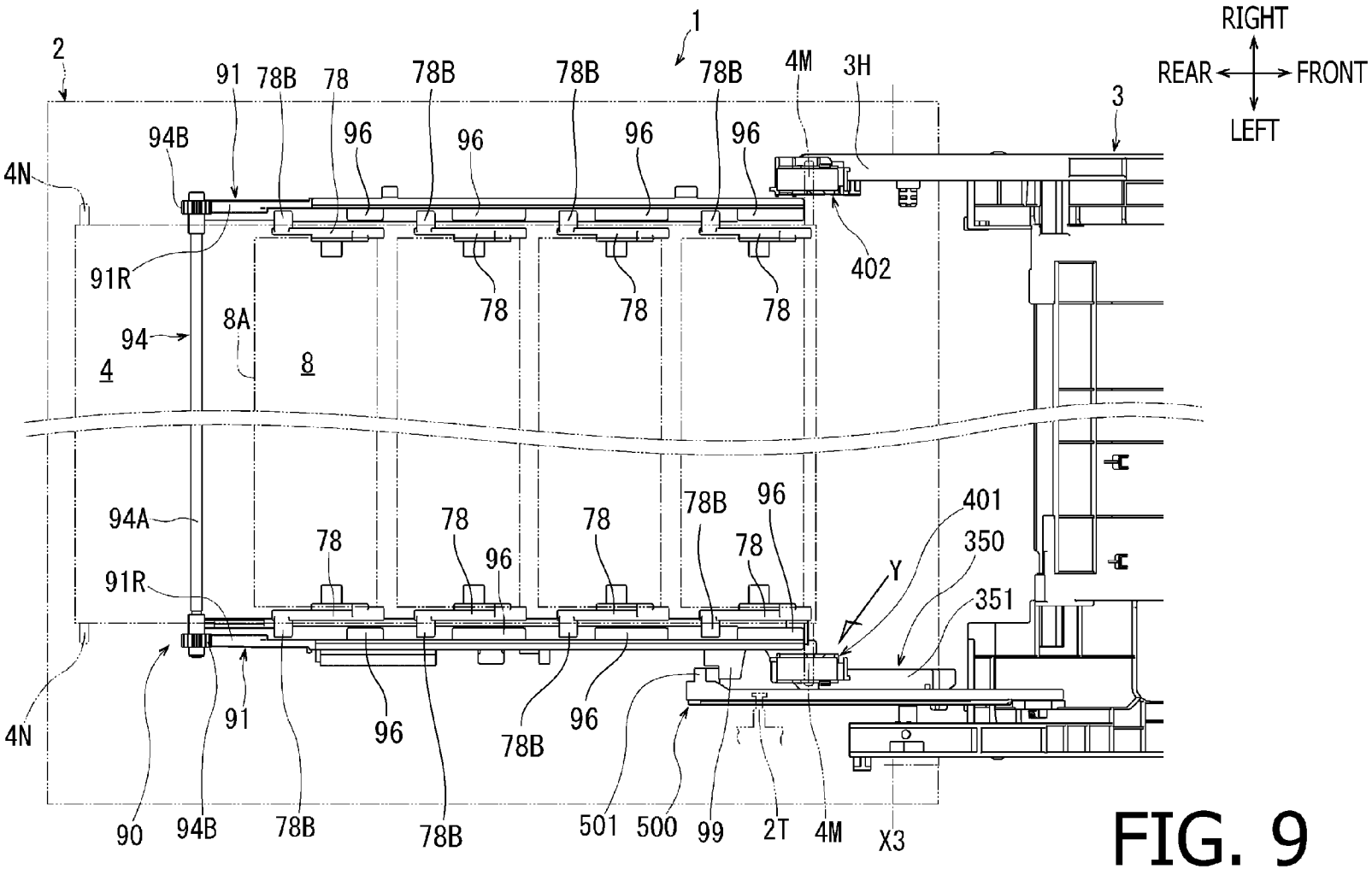
FIG. 9 is a plan view of the drawer, the developing unit, the contact/separation mechanism, the transmission enable/disable mechanism, the release mechanism, the cover and the link member of the image forming apparatus according to the illustrative embodiment.
Figure 13:
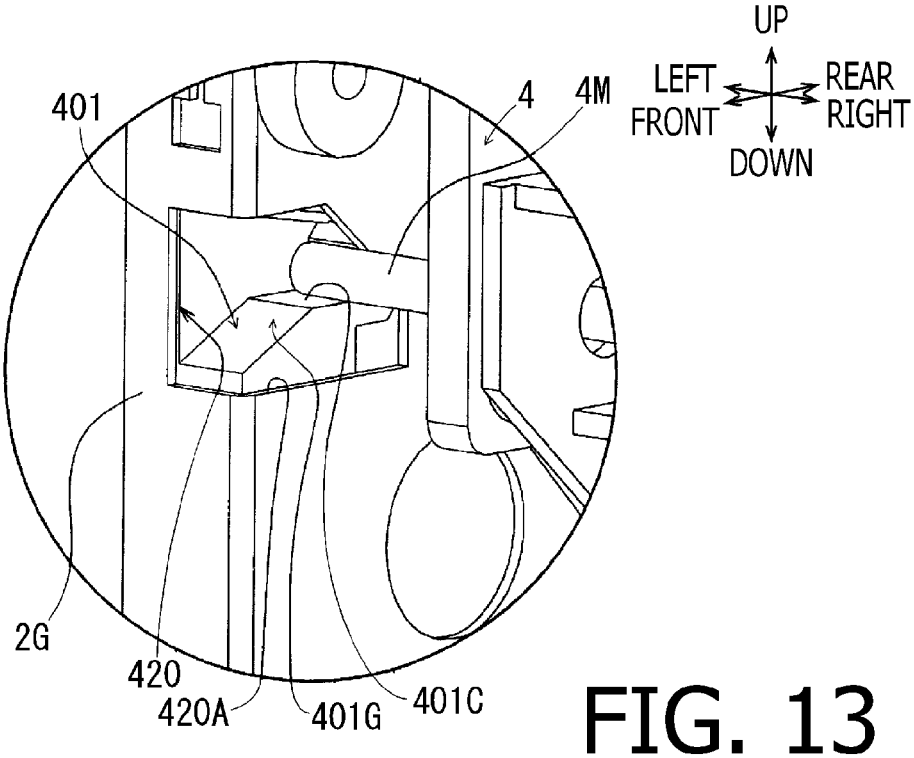

FIG. 13 is a partial perspective view, which is viewed along arrow Y in FIG. 9, showing the release mechanism located at a released position.

DETAILED DESCRIPTION OF THE ILLUSTRATIVE EMBODIMENT

Figure 1:
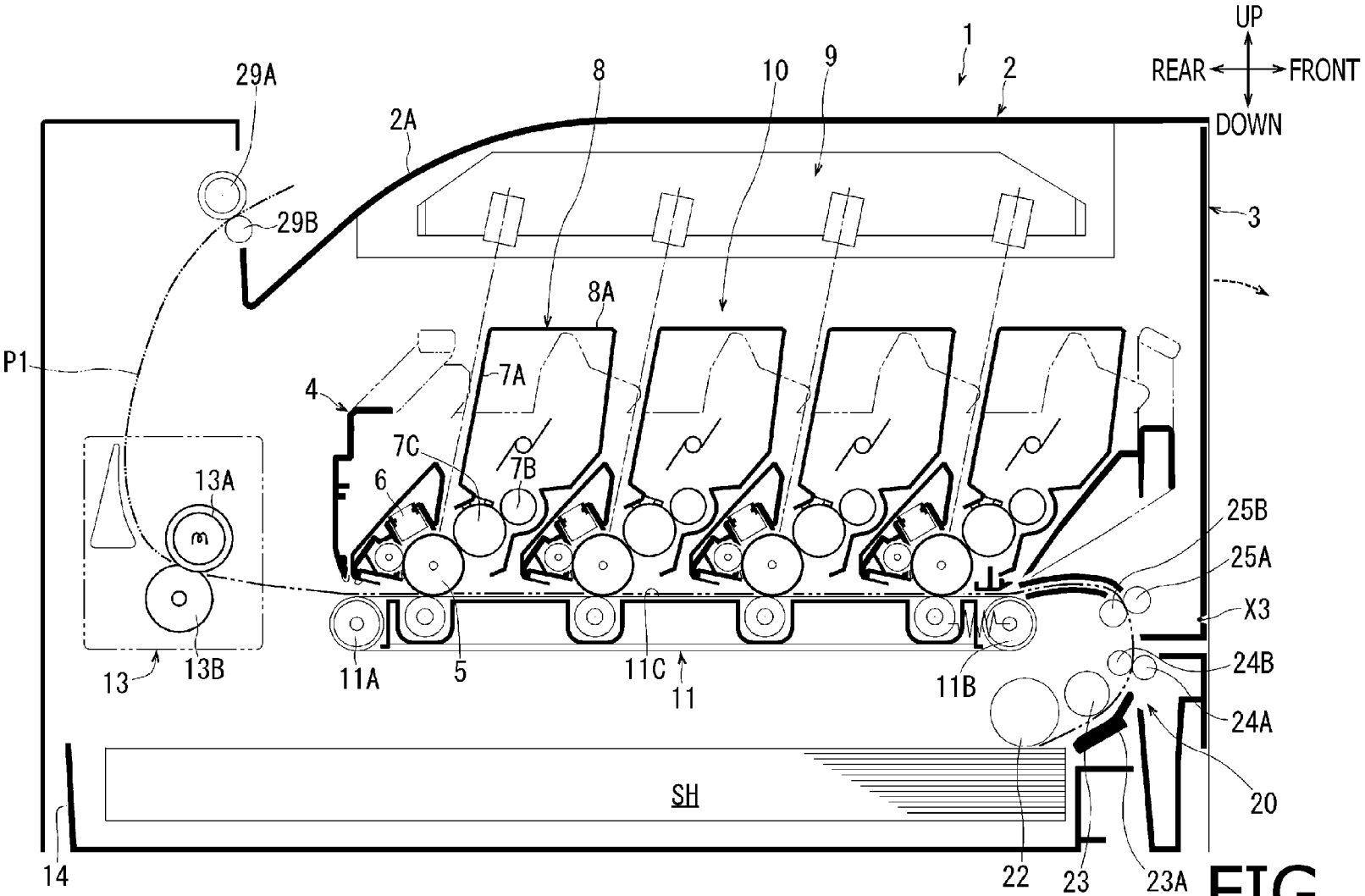
FIG. 1 is a cross-sectional view schematically showing an inner configuration of an image forming apparatus according to an illustrative embodiment.

An image forming apparatus 1 (see FIG. 1) according to an illustrative embodiment is a color laser printer which is configured to form color images on a sheet (e.g., a printing sheet, an OHP (overhead projector) sheet and the like) using an electrophotographic image forming method. In FIG. 1, a right-hand side of the drawing is defined as a front side of the image forming apparatus 1 and a left-hand side is defined as a rear side thereof. A left-hand side of the image forming apparatus 1 when viewed from the front side (i.e., a closer side of a plane of FIG. 1) is defined as a left side of the image forming apparatus 1, and the opposite side (i.e., a farther side of a plane of FIG. 1) is defined as a right side of the image forming apparatus 1. An upside and a down side of FIG. 1 are defined as an upside and a down side of the image forming apparatus 1, respectively. The above definitions of the directions with respect to the image forming apparatus apply to the following description and the drawings.

<Overall Configuration>

The image forming apparatus 1 has a box-shaped housing 2. On an upper surface of the housing 2, a sheet discharge tray 2A is formed as a portion recessed downward. At a lower portion of the housing 2 a sheet cassette 14 are detachably provided. The sheet cassette 14 has a box-like shape with its upper surface being opened. The sheet cassette 14 accommodates a plurality of sheets SH in a stacked manner.

The image forming apparatus 1 has a front cover 3 (see FIGS. 1-9). The front cover 3 is arranged on the front surface of the housing 2, at a position above the sheet cassette 14. Each of FIGS. 3-9 shows the front cover 3 in a manner where an exterior panel 3P which is indicated by two-dotted lines in FIG. 2 is detached.

The front cover 3 covers the front side of the housing 2 from the front side when the front cover 3 is in an upright state (e.g., stands substantially vertically)(FIGS. 1-5). The front cover 3 is rotatably supported by the housing 2 such that the front cover 3 is rotatable about a rotation axis X3 defined at a lower end thereof. As the front cover 3 is rotated such that the upper end of the front cover 3 moves frontward and downward, the state of the front cover 3 changes to the state shown in FIGS. 8 and 9 via the states shown in FIGS. 6 and 7. In FIGS. 8 and 9, the front cover 3 is opened (i.e., an open state). When in the open state, the front cover 3 extends frontward substantially in a horizontal direction. In the open state, the front cover 3 does not cover the front surface of the housing 2.

A bulged part 3H is formed at a lower right portion of the front cover 3 (see FIGS. 2-9). When the front cover 3 is closed (FIGS. 3-5), the bulged portion 3H bulges toward the rear side with respect to the rotation axis X3. An outer surface of the bulged portion 3H is curved to have a substantially circumferential surface. When the front cover 3 is opened (FIG. 8), the bulged portion 3H bulges upward with respect to the rotation axis X3.

The image forming apparatus 1 has a single link member 500 (FIGS. 2-9). According to the illustrative embodiment, the link member 500 is made of resin. A front end portion 500A of the link member 500 is connected to a portion of the front cover 3 on the left side of the front cover 3 at a position above the rotation axis X3. The link member 500 extends obliquely upwardly from its front end portion 500A toward the rear side, then bent and extends substantially horizontally toward the rear side (FIGS. 3-8).

The link member 500 has a first groove 502 and a second groove 503 (FIGS. 3-8). The first groove 502 extends obliquely upwardly from a position in the vicinity of the front end portion 500A toward rear side. The first groove 502 is connected to a second cam 351 of a transmission enable/disable mechanism 350, which will be described later. The second groove 503 extends from an upper rear position with respect to the first groove 502 toward the rear side. As shown in FIGS. 2 and 9, on an inner left surface of the housing 2, an attitude maintaining protrusion 2T is formed to protrude toward the link member 500. The protrusion 2T engages with the second groove 503.

Figure 5:
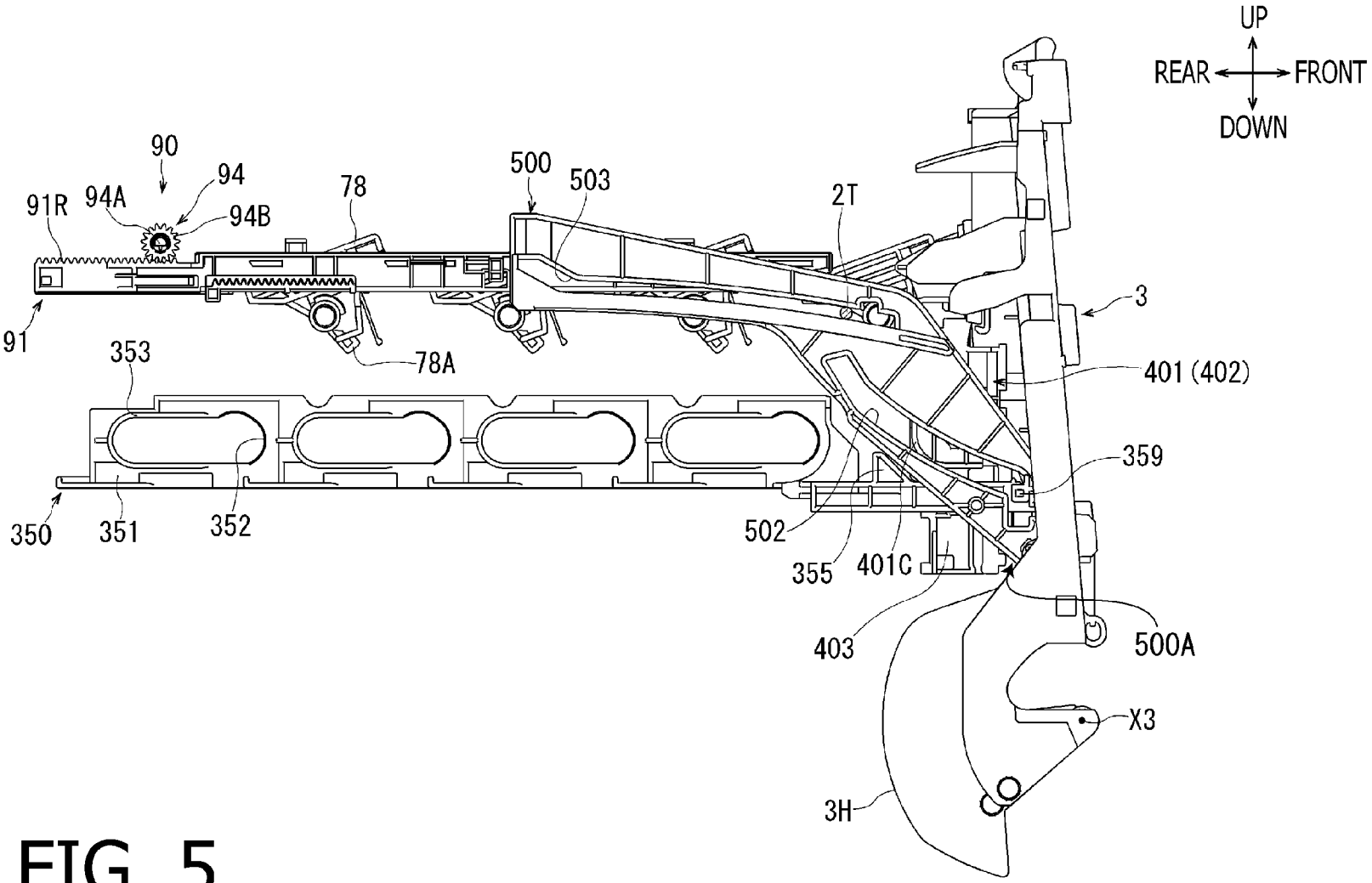
FIG. 5 is a side view of the contact/separation mechanism, the transmission enable/disable mechanism, the release mechanism, the cover and the link member of the image forming apparatus according to the illustrative embodiment.
Figure 6:
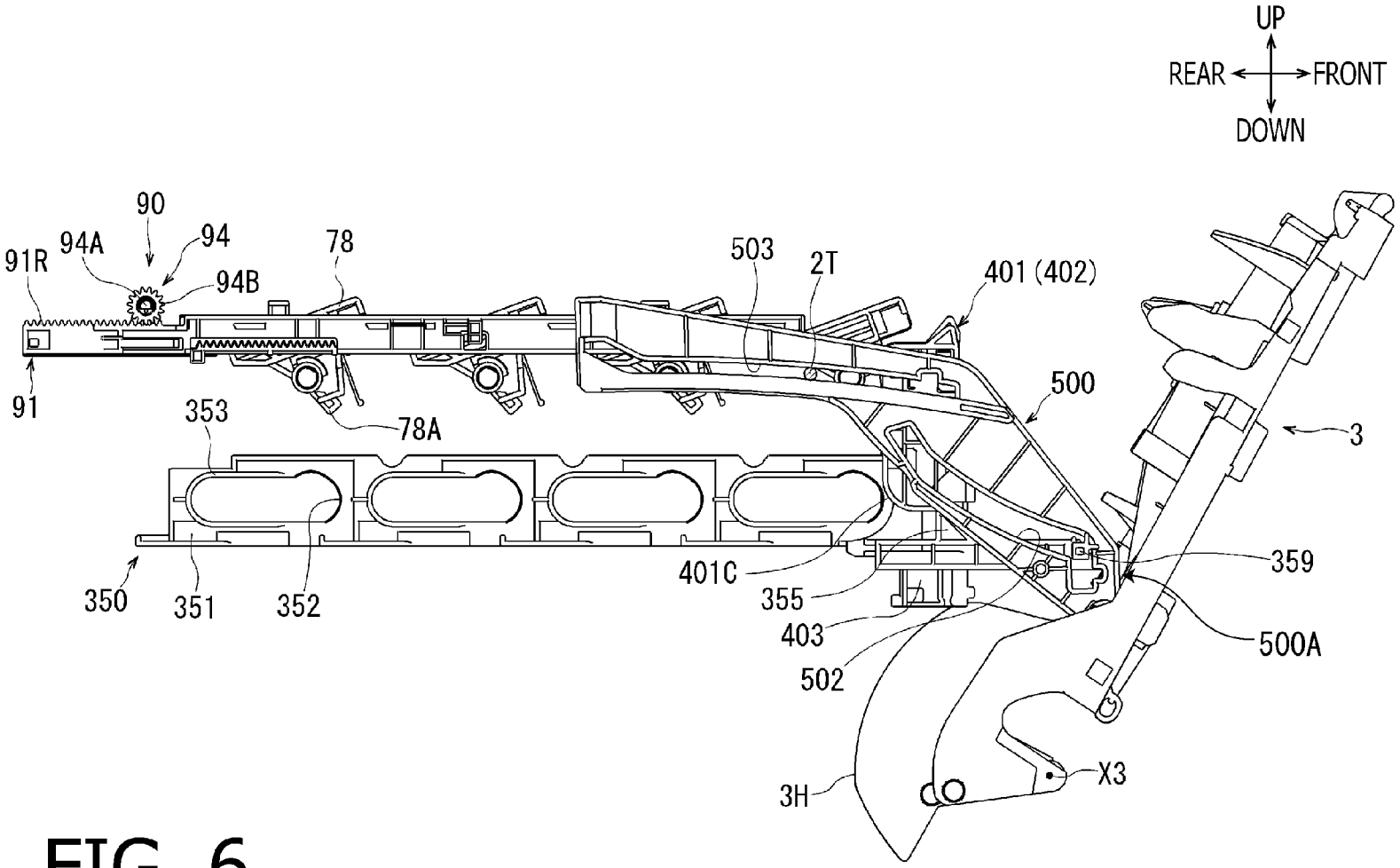
FIG. 6 is a side view of the contact/separation mechanism, the transmission enable/disable mechanism, the release mechanism, the cover and the link member of the image forming apparatus according to the illustrative embodiment.
Figure 7:
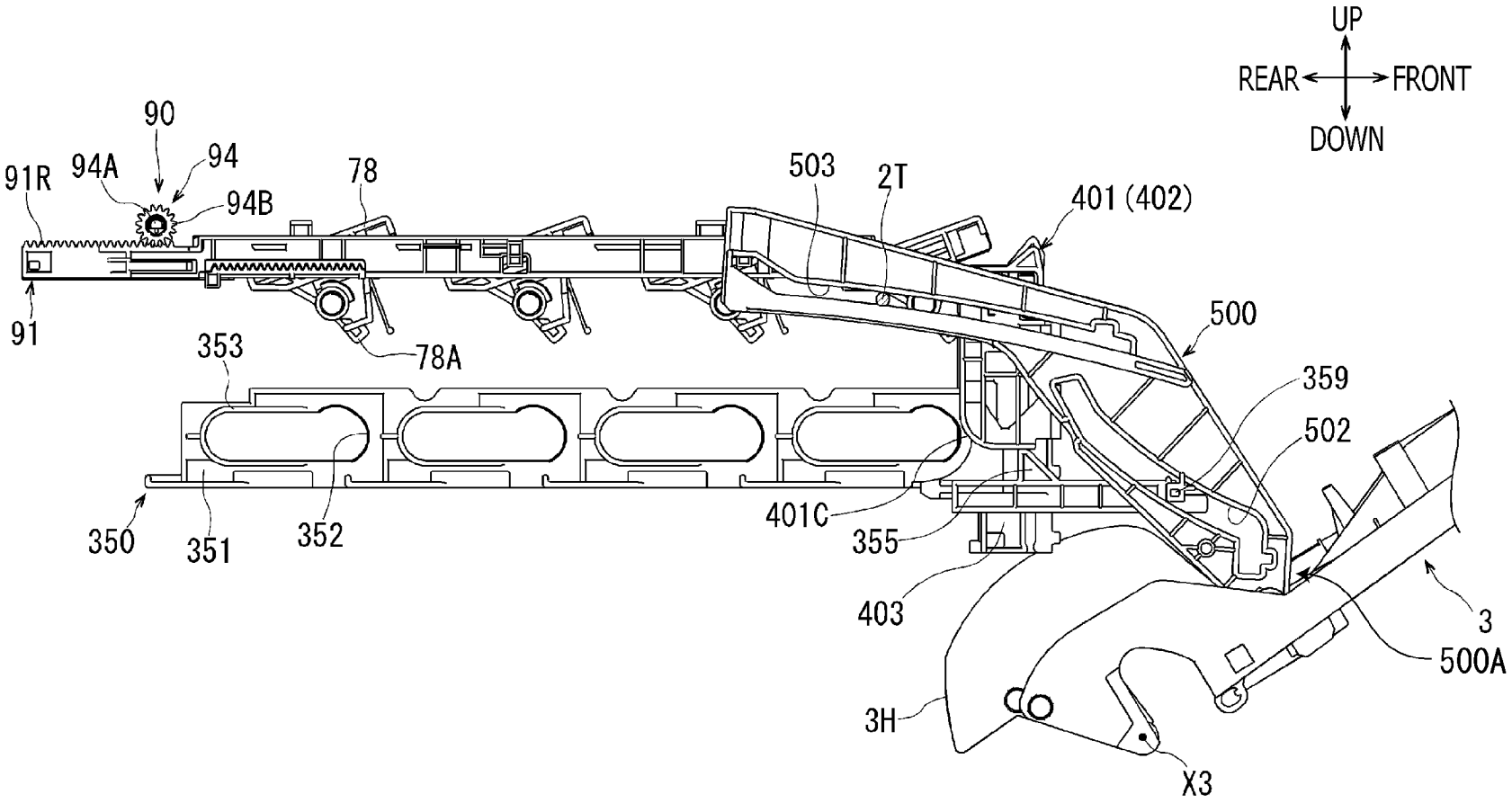
FIG. 7 is a side view of the contact/separation mechanism, the transmission enable/disable mechanism, the release mechanism, the cover and the link member of the image forming apparatus according to the illustrative embodiment.
Figure 8:
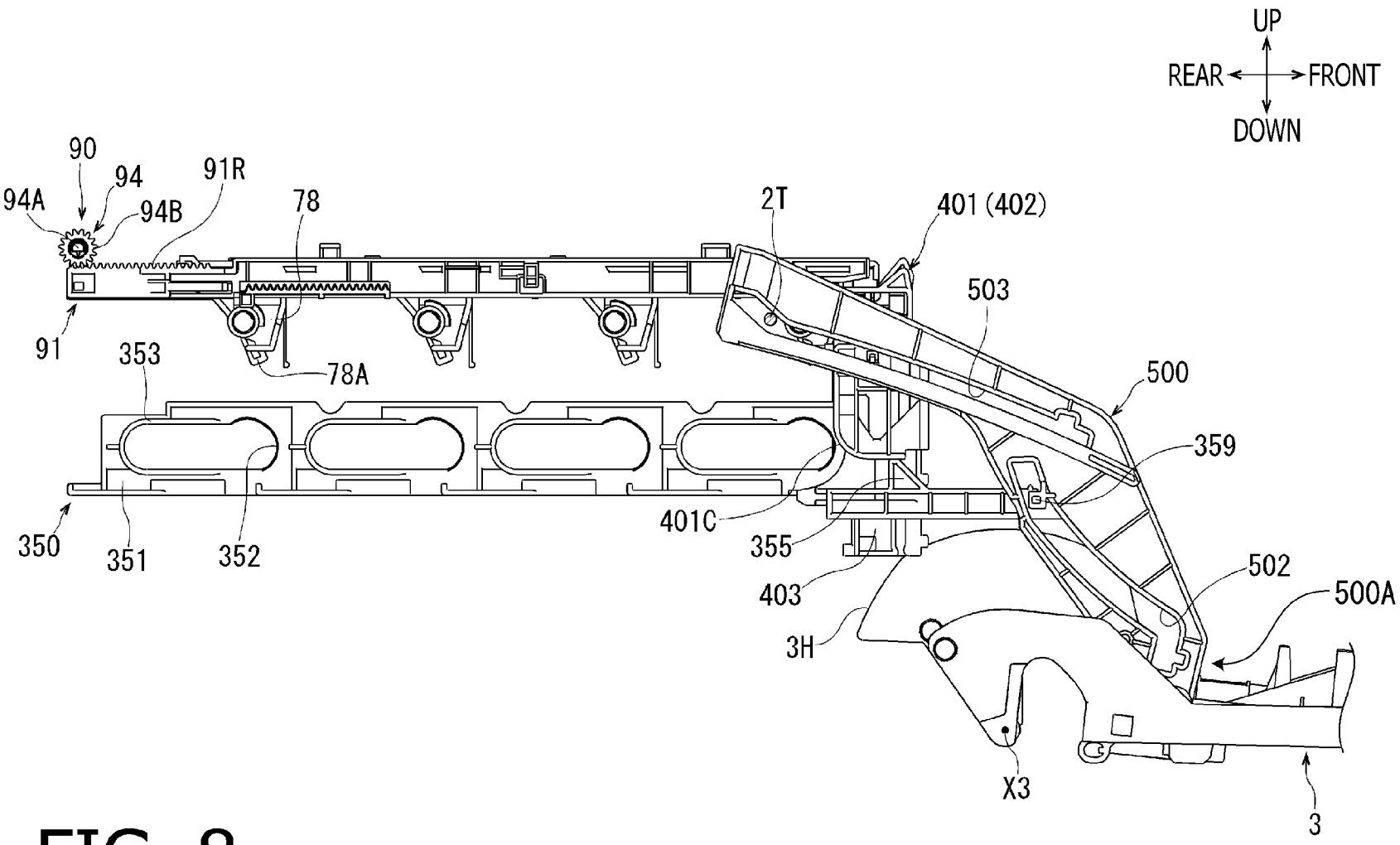
FIG. 8 is a side view of the contact/separation mechanism, the transmission enable/disable mechanism, the release mechanism, the cover and the link member of the image forming apparatus according to the illustrative embodiment.

When the front cover 3 moves from the close position (FIG. 5) to the open position (FIG. 8) via the positions shown in FIGS. 6 and 7, the front cover 3 pulls the front end portion 500A of the link member 500 frontward. Thus, in association with an opening movement of the front cover 3, the link member 500 moves frontward. During this movement, an attitude maintaining protrusion 2T relatively moves from the front end portion to the rear end portion of the second groove 503, and the attitude of the link member 500 is maintained (FIGS. 5-8). That is, the attitude of the link member 500 is maintained stably as the front end portion 500A is connected to the front cover 3 and the attitude maintaining protrusion 2T engages with the second groove 503 (i.e., the link member 500 is supported at two positions).

When the front cover 3 moves from the open position (FIG. 8) to the close position (FIG. 5) via the positions shown in FIGS. 6 and 7, the front cover 3 pushes the front end portion 500A of the link member 500 rearward. Thus, in association with the closing movement of the front cover 3, the link member 500 moves rearward. Also in this case, the attitude maintaining protrusion 2T relatively moves from the rear end portion to the front end portion of the second groove 503 (FIGS. 5-8), and the attitude of the link member 500 is maintained.

A protruded part 501 is formed at the rear end portion of the link member 500 (FIGS. 2-4 and 9). The protruded part 501 is formed to protrude rightward. The protruded part 501 is connected to a first cam 91 of the contact/separation mechanisms 75 and 90. It is noted that the expression that "the protruded part 501 is connected to the first cam 91" implies not only a configuration in which the protruded part 501 is always connected to the first cam 91 but a condition in which the protruded part 501 alternately switching a connected and a disconnected states. According to the illustrative embodiment, the protruded part 501 is alternately contacted and separated from the first cam 91.

Inside the housing 2, a sheet path P1 extending from the sheet cassette 14 to the discharge tray 2A is defined. Specifically, the sheet path P1 starts from the front end portion of the sheet cassette 14, extends toward the front surface of the housing 2, makes a U-turn (i.e., turns upward and then extends rearward). The sheet path P1 further extends substantially horizontally toward the rear surface of the housing 2, makes another U-turn (i.e., turns upward and then turns frontward) and reaches the discharge tray 2A.

Inside the housing 2, a feed unit 20, an image forming unit 10 and a pair of discharge rollers 29A and 29B are arranged above the sheet cassette 14. As is conventionally known, such units/rollers are assembled to a frame member provided inside the housing 2. Since such a structure has been conventionally employed, the frame is not shown in the drawings.

The feed unit 20 feeds the sheets SH accommodated in the sheet cassette 14 to the sheet path P1 one by one with use of a feed roller 22, a separation roller 23 and a separation pad 23A. The feed unit 20 further conveys the sheet SH toward the image forming unit 10 with use of a pair of conveying rollers 24A and 24B and a pair of register rollers 25A and 25B, which are provided to the sheet path P1 at a front side portion where the sheet path P1 makes the U-turn.

The image forming unit 10 is of a so-called direct tandem type. The image forming unit 10 has a conveying belt 11, four photoconductive drums 5, four process cartridges 8, a scanner unit 9 and a developing unit 13.

The conveying belt 11 is arranged below the photoconductive drums 5 and the process cartridges 8 with the substantially horizontal part of the sheet path P1 being sandwiched therebetween. The conveying belt 11 is an endless belt wound around a driving roller 11A and a driven roller 11B (FIG. 1). The driving roller 11A is arranged at a rear side position inside the housing 2, and configured to rotate about a rotation axis extending in the right-and-left direction. The driven roller 11B is arranged at a front side position inside the housing 2, and configured to rotate about a rotation axis which is parallel with the rotation axis of the driving roller 11A. An upper portion of the conveying belt 11 between the driving roller 11A and the driven roller 11B extending substantially horizontally (i.e., extending along the sheet path P1) defines a substantially horizontal surface which will be referred to as a conveying surface 11C.

The sheet fed, by the feed unit 20, from the sheet cassette 14 toward the sheet path P1 is further conveyed with being attracted by the conveying surface 11C, and passes below the photoconductive drums 5 and the process cartridges 8.

According to the illustrative embodiment, there are four photoconductive drums 5 and four process cartridges 8, which correspond to four colors of black, yellow, magenta and cyan.

Each photoconductive drum 5 has a cylindrical shape extending in the right-and-left direction, and faces the conveying surface 11C from the above. the four photoconductive drums 5 are arranged in the front-and-rear direction along the horizontally extending portion of the sheet path P1. In the vicinity of each photoconductive drum 5, a charger 6 is provided. Specifically, the charger 6 faces an outermost layer, which is a photoconductive layer of positive-charge characteristic (i.e., to be charged positively). A driving force of the driving source 300M is transmitted via the driving force transmission unit 300 to the photoconductive drums 5, which rotate synchronously.

The process cartridges 8 are arranged above the photoconductive drums 5, respectively, and in the front-and-rear direction along the horizontally extending portion of the sheet path P1. Each process cartridge 8 has a developing frame 8A, which has a box-like shape extending in the right-and-left direction.

Each process cartridge 8 is configured such that a toner chamber 7A, a supplying roller 7B and a developing roller 7C are accommodated inside the developing frame 8A. The toner chamber 7A is arranged at an upper portion inside the developing frame 8A and accommodates toner. The supplying roller 7B is arranged at a lower portion inside the developing frame 8A. The developing roller 7C is exposed to outside through an opening of the developing frame 8A and faces the photoconductive drum 5. The toner accommodated in the toner chamber 7A is supplied to the developing roller 7C as the supplying roller 7B rotates, and carried by the circumferential surface of the developing roller 7C. The thickness of the toner carried by the circumferential surface of the developing roller 7C is regulated to a predetermined thickness, then supplied to the surface of the photoconductive drum 5.

The scanner unit 9 is arranged above the photoconductive drums 5 and the process cartridges 8. The scanner unit 9 is of a well-known structure, and includes a laser beam source, a polygonal mirror, an f-theta lens, a reflector and the like. The scanner unit 9 is configured to emit laser beams to the photoconductive drums 5 from the above.

The fixing unit 13 is arranged at a lower portion of the sheet path P1 at a part where the sheet path P1 is U-turned on a rear side. In other words, the fixing unit 13 is arranged on a downstream side with respect to the image forming unit 10 of the sheet path P1. The fixing unit 13 has a heat roller 13A and a pressure roller 13B which face each other with the sheet path P1 sandwiched therebetween.

The discharge rollers 29A and 29B are arranged at an upper portion of the sheet path P1 and at a part where the sheet path P1 is U-turned on the rear side, that is, at the most downstream side of the sheet path P1, and face the discharge tray 2A.

The image forming unit 10 forms an image on a sheet SH, which is conveyed along the sheet path P1, in accordance with the following manner (i.e., an electrophotographic image formations process). The circumferential surface of each photoconductive drum 5 is uniformly and positively charged by the charger 6 while rotating. Then, the charged surface of each photoconductive drum 5 is exposed to the laser beam emitted by the scanner unit 9. As a result, on the circumferential surface of each photoconductive drum 5, an electrostatic latent image corresponding to the image to be formed is formed. Next, toner of respective colors is supplied from the toner chambers 7A to the circumferential surfaces of the photoconductive drums 5 by the supplying rollers 7B and the developing rollers 7C of respective process cartridges 8, thereby toner images being formed on the respective photoconductive drums 5. The toner images are transferred onto the sheet SH as the photoconductive drums 5 contact the sheet SH conveyed by the conveying surface 11C and negative voltage is applied to the conveying surface 11C.

The sheet SH having passed below the process cartridges 8 reaches a nip between the heat roller 13A and the pressure roller 13B, and heat and pressure are applied to the sheet SH carrying the transferred toner image, thereby the toner image being fixed thereto. Thereafter, the sheet SH is further conveyed by the discharge rollers 29A and 29B, and discharged on the discharge tray 2A.

It is noted that the image forming apparatus 1 according to the illustrative embodiment has a drawer 4, the driving force transmission unit 300, the transmission enable/disable mechanism 350, the contact/separation mechanisms 75 and 90, and release mechanisms 401 and 402.

<Drawer>

The drawer 4 is a frame-like member surrounding the photoconductive drums 5 and the process cartridges 8 from the front, rear, right and left sides (see FIGS. 1, 2, and 9). The drawer 4 rotatably supports the photoconductive drums 5, and detachably holds the process cartridges 8. Such a structure of the drawer is well-known, and the description will be simplified for brevity.

When the front cover 3 is opened (see FIGS. 8 and 9), and the front surface of the housing 2 is not covered with the front cover 3, the drawer 4 can be drawn out of the main body of the image forming apparatus 1. When the drawer 4 is drawn frontward from the housing 2, the process cartridges 8 are exposed to outside the housing 2, and can be detached from the drawer 4. By inserting the drawer 4 in the housing 2 (i.e., moved rearward), the drawer 2 is attached to the housing 2.

In the description, the main body of the image forming apparatus 1 includes components of the image forming apparatus 1 excluding the photoconductive drums 5, the process cartridges 8 and the drawer 4. Thus, the main body includes the housing 2, the frame member, the sheet feed unit 20, the scanner unit 9, the conveying belt 11 and the fixing unit 13. It is noted that, according to the illustrative embodiment, the drawer 4 can be detached from the main body after fully drawn from the housing 2. It is noted that, in another embodiment, the drawer 4 may be configured to not be detached from the main body.

On right front and left front corner portions of the drawer 4, positioning protrusions 4M are provided. The front positioning protrusions 4M are cylindrical shaft members each extending in the right-and-left direction, spaced from each other in the right-and-left direction, and having a common central axis. On right rear and left rear corner portions, rear positioning protrusions 4N are provided. The positioning protrusions 4N are also cylindrical shaft members each extending in the right-and-left direction, spaced from each other in the right-and-left direction, and having a common central axis.

When the drawer 4 is attached inside the housing (e.g., FIG. 2), the front positioning protrusions 4M are held by release mechanisms 401 and 402, which are provided at front right/left corners 3 inside the housing 2. Further, the rear positioning protrusions 4N are abutted to respective engage portions which are recessed portions defined on the frame member (not shown). With the above configurations, the drawer 4 is positioned inside the housing 2.

<Driving Force Transmission Unit>

The driving force transmission unit 300 is provided inside the housing 2 (see FIG. 10). The driving force transmission unit 300 is assembled with a frame member 2F which faces the drawer 4 from the left side when the drawer 4 is fully inserted in the housing 2. The driving source 300M is also assembled to the frame member 2F. According to the illustrative embodiment, the driving source 300M is an electric motor. It is noted that FIG. 10 shows a structure of the driving force transmission unit 300 for one photoconductive drum 5. Since the structures of the other driving force transmission unit 300 are the same as that show in FIG. 10, further description will not be provided for brevity.

The driving source transmission unit 300 includes a driving gear 301 and a transmission gear train 309. The driving gear 301 is rotatably supported by a supporting shaft 301A. The supporting shaft 301A is fixed to the frame member 2F. The supporting shaft 301A is arranged to be coaxial with a rotational axis X5 of the photoconductive drum 5, and extends toward left side end of the photoconductive drum 5. The transmission gear train 309 includes a plurality of gears connecting the driving source 300M with the driving gear 301.

A boss 302 is formed to the driving gear 301 such that the boss 301 protrudes rightward. A coupling 303 is fitted on the boss 302 such that the coupling 303 is movable in the right-and-left direction (i.e., in the direction of the rotational axis X5 of the photoconductive drum 5). The coupling 303 is biased to separate from the driving gear 301 by a coil spring 303S provided between the driving gear 301 and the coupling 303. On a right surface of the coupling 303, engaging protrusions 303A and 303B are formed (see FIG. 10).

On the left side end of the photoconductive drum 5, an engagement part 305 is provided to rotate integrally with the photoconductive drum 5. On the left side surface, which faces the coupling 303, of the engagement part 305, engagement holes 305A and 305B are formed. When the coupling 303 is biased rightward by the coil spring 303S so as to be separated from the driving gear 301, the engaging protrusions 303A and 303B engage with the engagement holes 305A and 305B, respectively (see FIG. 10). With this configuration, the driving gear 301 and the photoconductive drum 5 are connected integrally, and rotate about the rotation axis X5. When the driving source 300M is controlled to generate a driving force, the thus generated driving force is transmitted to the photoconductive drum 5 through the transmission gear train 309, the driving gear 301, the coupling 303 and the engagement part 305. In the following description, such a position (i.e., a position shown in FIG. 10) of the coupling 303 will be referred to as a transmission position.

Although not shown in the drawings, when the coupling 303 is displaced leftward, against the biasing force of the coil spring 303S, and approaches the driving gear 301, the engaging protrusions 303A and 303B do not engage with the engagement holes 305A and 305B. Therefore, in such a case, the driving gear 301 is not connected to the photoconductive drum 5. In the following description, such a position of the coupling 303 (i.e., a position at which the coupling 303 is displaced leftward and the engaging protrusions 303A and 303B do not engage with the engagement holes 305A and 305B) will be referred to as a disconnect position of the coupling.

<Transmission Enable/Disable Mechanism>

The transmission enable/disable mechanism 350 includes a second cam 351 (see FIGS. 2-9). According to the illustrative embodiment, the second cam 351 is a resin member extending in the front-and-rear direction. Four elongated holes 352 and four sliding parts 353 are formed on the second cam 351. The four elongated holes 352 are through holes and arranged in the front-and-rear direction. Each elongated hole 352 is oriented such that the longitudinal direction thereof is aligned in the front-and-rear direction. The sliding parts 353 extend leftward from the peripheries of the elongated holes 352, respectively.

The second cam 351 protrudes frontward with respect to the front side one of the elongated holes 352 (FIGS. 2-9). At the front end portion of the second cam 351, an engaging part 359 is formed. The engaging part 359 protrudes leftward and engages with the first groove 502 (FIGS. 3 and 5-8).

The second cam 351 has a protrusion 355 (FIGS. 3-8). The protrusion 355 is provided on the front end portion of the second cam 351, at a position which is on the rear side with respect to the engaging part 359, and protrudes upward. Further, the protrusion 355 has an inclined surface which upwardly inclines toward the rear side.

Figure 3:
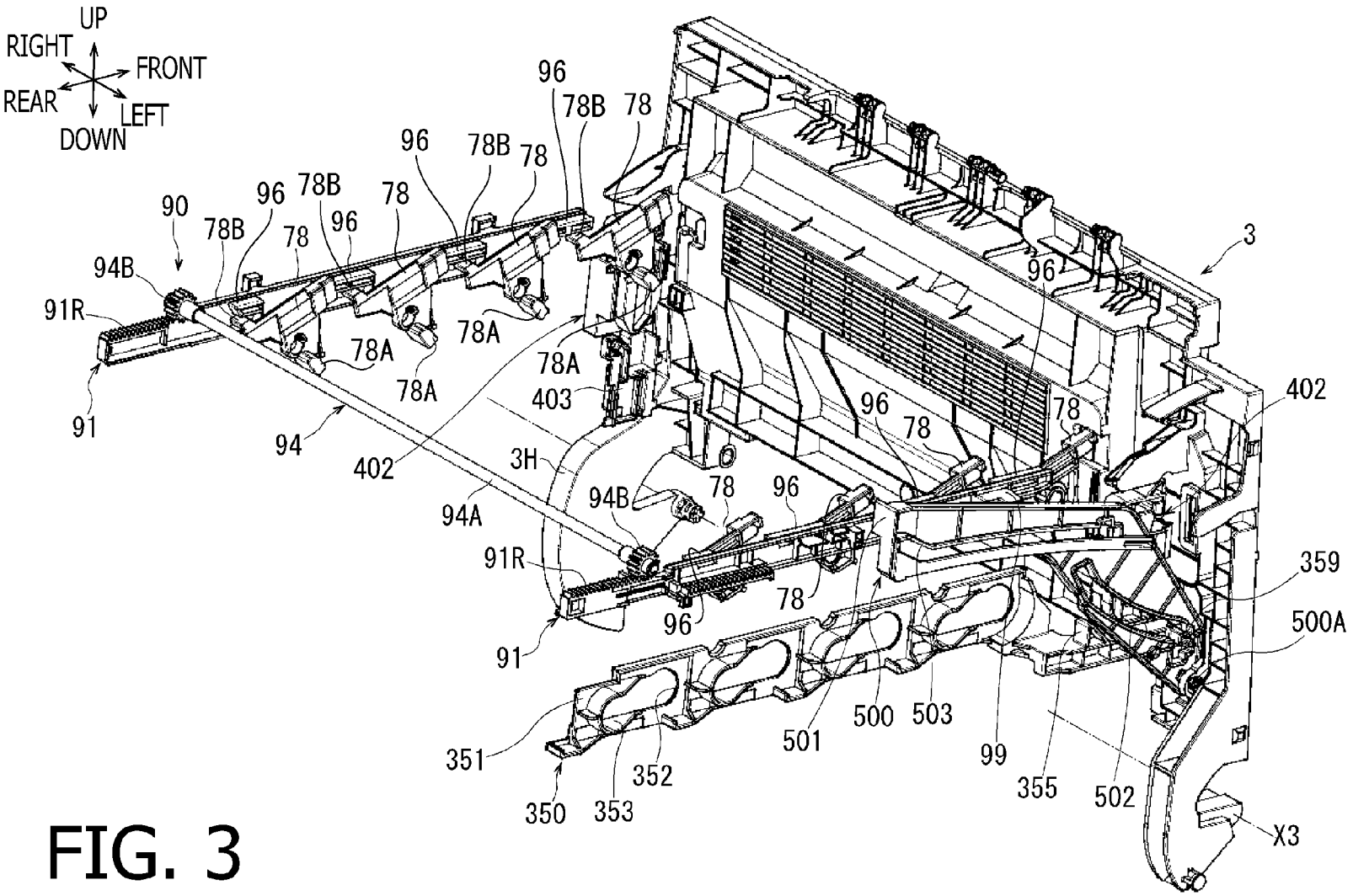
FIG. 3 is a perspective view of the contact/separation mechanism, the transmission enable/disable mechanism, the release mechanism, the cover and the link member of the image forming apparatus according to the illustrative embodiment.
Figure 4:
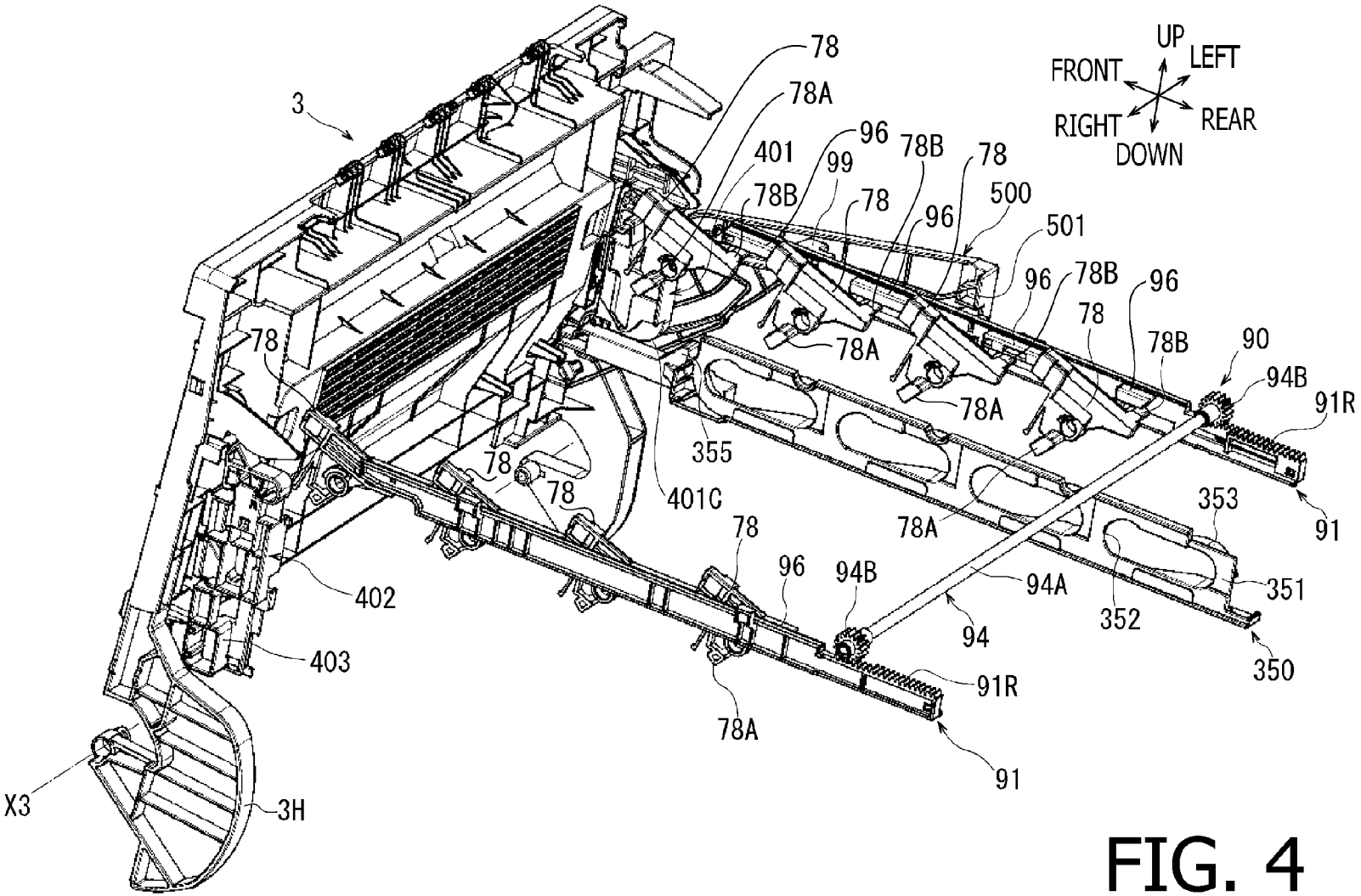
FIG. 4 is a perspective view of the contact/separation mechanism, the transmission enable/disable mechanism, the release mechanism, the cover and the link member of the image forming apparatus according to the illustrative embodiment.

When the front cover 3 is closed, the engaging part 359 is located at a position close to the front end of the first groove 502 formed on the link member 500 (FIGS. 3 and 5). When the front cover 3 is opened (FIGS. 8 and 9) via the positions shown in FIGS. 6 and 7, the engaging part 359 relatively moves toward the rear end side of the first groove 502, and pushed frontward by the inner wall surface of the first groove 502. With this configuration, the second cam 351 moves from the position shown in FIGS. 2-5 to the position shown in FIGS. 8 and 9.

When the opened front cover 3 is closed (FIGS. 3 and 5) via the positions shown in FIGS. 6 and 7, the engaging part 359 relatively moves frontward in the first groove 502, and pushed rearward by the inner wall of the first groove 502. With this configuration, the second cam 351 moves from the position shown in FIGS. 8 and 9 to the position shown in FIGS. 2-5.

As shown in FIG. 10, the coupling 303 is inserted through the elongated hole 352. The second cam 351 is located on the right side of and close to the coupling 303, and extends in the front-and-rear direction, inside the housing 2. The second cam 351 is supported by a frame member (not shown) such that the second cam 351 can linearly move in the front-and-rear direction. It is noted that the position of the second cam 351 shown in FIG. 10 corresponds to the positions of the same shown in FIGS. 2-5.

The sliding part 353 has an inclined surface 353A and a holding surface 353B. The inclined surface 353A extends on the rear side with respect to the flange 303F of the coupling 303, with being inclined rearward and rightward. The holding surface 353B is connected to the rear end of the inclined surface 353A and extends in the front-and-rear direction.

When the link member 500 moves in association of an opening operation of the front cover 3, the first groove 502 pushes the engaging part 359 frontward and the second cam 351 moves from a position shown in FIGS. 2-5 and 10 to the front side position as shown in FIGS. 8 and 9. Then, the inclined surface 353A shown in FIG. 10 slidably contacts the flange 303F of the coupling 303, pushes the coupling 303 leftward against the biasing force of the coil spring 303, thereby the coupling 303 being located at the disconnection position. As a result, the engaging protrusions 303A and 303B are released from engagement with the engagement holes 305A and 305B, respectively. Further, the holding surface 353B contacts the flange 303F from the right side, and holds the coupling 303 at the disconnection position.

When the front cover 3 is closed, the link member 500 moves in association with the closing operation of the front cover 3, the first groove 502 pushes the engaging part 359 rearward and the second cam 351 returns the position shown in FIG. 10. Then, the coupling 303 is biased by the coil spring 303S and returns to the transmission position which is the position shown in FIG. 10.

<Contact/Separation Mechanism>

The contact/separation mechanisms include the contact mechanism 75 provided to the drawer 4 (FIGS. 11A and 11B) and the separation mechanism 90 provided inside the housing (FIGS. 2-9). Since the contact/separation mechanisms 75 and 90 are of well-known type, detailed description thereof will be omitted for brevity.

The contact mechanism 75 is provided to each of side surfaces which sandwich the process cartridges 8 from the right and left side (FIGS. 11A and 11B). Each contact mechanism 75 has four pressing cams 76 and four pressing springs 77.

On each of the right and left side surfaces of each process cartridge 8, at an upper front position, a pressed part 8B having a cylindrical shape is protruded. Further, at a lower rear position of each of the side surfaces of each process cartridge 8, a guided part 8C having a cylindrical shape is protruded. On each of side surfaces of the drawer 4 sandwiching the process cartridges 8 from the right and left sides, guiding grooves 4G are formed. Each guiding groove 4G is shaped to extend downward and then bent rearward so as to approach the photoconductive drum 5 (FIGS. 11A and 11B).

When the process cartridges 8 are mounted to the drawer 4, the guided parts 8C are guided by the corresponding guiding grooves 4G. The pressing springs 77 urge the pressing cams 76 such that the pressed parts 8B are moved downward. As a result, the process cartridges 8 are biased in the direction where the developing rollers 7C approach the photoconductive drums 5, respectively. When the process cartridges 8 are detached from the drawer 4, the pressing cams 76 rock (rotate) such that the pressing cams 76 do not interfere with the pressed parts 8B, so that the detachment of the process cartridges 8 is not obstructed.

On the right and left side surfaces of each process cartridge 8, rocking members 78 are provided, respectively (FIGS. 2-5, 11A and 11B). The rocking members 78 are rotatably supported on the right and left surfaces of each process cartridge 8 such that the rocking members 78 can rotate about a rocking axis X78 (FIGS. 11A and 11B). The rocking members 78 are biased by biasing members (not shown) such that the rocking members 78 tend to rotate clockwise in FIGS. 11A and 11B (i.e., tend to change their positions from ones shown in FIG. 11A to ones shown in FIG. 11B).

Below the rocking axis X78 of each rocking member 78, a protruded part 78A is formed (FIGS. 3-9, 11A and 11B). On an upper rear side with respect to the rocking axis X78, an input part 78B is protruded (FIGS. 2-4, 9, 11A and 11B). When the process cartridges 8 are mounted on the drawer 4 (FIGS. 11A and 11B), the protruded parts 78A are received by recessed parts 4F formed on the right and left side surfaces of the drawer 4, which surfaces sandwich the process cartridges 8 from the right and left sides.

When each rocking member 78 is in a condition shown in FIG. 11A, the developing roller 7C contacts the photoconductive drum 5 (i.e., located at a contact position), and the developing roller 7C is urged to the photoconductive drum 5 by the pressing spring 77 and the pressing cam 76.

When the rocking member 78 moves from the position shown in FIG. 11A to the position shown in FIG. 11B, the process cartridge 8 is lifted as the rocking member 78 rotates about the protruded part 78A which is received by the recessed part 4F, thereby the developing roller 7C is spaced from the photoconductive drum 5.

The separation mechanism 90 has a pair of first cams 91 and sync-movement mechanism 94. Each first cam 91 is supported by inner frames (not shown) sandwiching the drawer 4 from the right and left sides, inside the housing 2, such that the first cam 91 can linearly move in the front-and-rear direction.

The left side first cam 91 and the right side first cam 91 have symmetrical shapes. Each first cam 91 has four cam portions 96 which are arranged in the front-and-rear direction (FIGS. 2-4 and 9). Each of the cam portions 96 is shaped to protrude toward an input part 78B of the rocking member 78 of the process cartridge 8. The lower part of the rear end portion of each cam part 96 is inclined upward. On the front end of the left side first cam 91, an engaging part 99 is formed to protrude leftward. When the front cover 3 is closed, the protruded part 501 of the link member 500 is spaced rearward from the engaging part 99 (FIGS. 2-4).

The sync moving mechanism 94 has a connection shaft 94A extending in the right-and-left direction, and a pinion gears 94B secured to right and left ends of the connecting shaft 94A (FIGS. 2-4). The right and left pinion gears 94B engage with racks 91R which are formed on rear end portions of the right and left first cams 91, respectively. With the above configuration, the right and left first cams 91 are linearly movable in the front-and-rear direction in a synchronized manner.

When the first cams 91 are located at positions shown in FIGS. 2-5, the cam portions 96 contact the input parts 78B of the corresponding rocking members 87 from the above to push down the input parts 78B. Accordingly, the rocking members 78 are located at positions shown in FIG. 11A, and the process cartridges 8 are located at the attached positions.

When the first cams 91 are moved from the positions shown in FIGS. 2-5 to the positions shown in FIGS. 8 and 9 via the positions shown in FIGS. 6 and 7, each cam part 96 is spaced frontward from the input part 78B of the rocking member 78. Thus, the input parts 78B are not pressed at this stage. As a result, the rocking members 78 are moved to the positions shown in FIG. 11B, and the process cartridges 8 are moved to the separated position. When the first cams 91 are moved from the positions shown in FIGS. 8 and 9 to the positions shown in FIGS. 2-5 via the positions shown in FIGS. 6 and 7, each cam part 96 contacts the input part 78B of the corresponding rocking member 78 from the above, thereby the input parts 78B being pushed downward. As a result, each of the rocking members 78 rocks to be moved to the position shown in FIG. 11A and each process cartridges 8 is moved to the contact position.

Switching of the location of the process cartridges 8 between the contact positions and separated positions is performed by moving the first cams 91 in the front-and-rear direction as a controller (not shown) controls an electrical motor, when a warming-up operation, an image forming operation and/or no operation are being performed.

According to the illustrative embodiment, since the link member 500 moves in association with opening movement of the front cover 3, the process cartridges 8 are moved from the contact positions to the separated positions which are also detachable positions. Specifically, when the link member 500 moves in association with the opening movement of the front cover 3 (FIGS. 6-9), the protruded part 501 moves from a position shown in FIG. 2 to a position shown in FIG. 9. During this movement, the protruded part 501 contacts the engaging part 99 and pushes the engaging part frontward. As a result, the first cams 91 are moved to the positions shown in FIGS. 8 and 9 by the engaging parts 99 and the process cartridges 8 are moved to the removable positions (i.e., detached positions) with the front cover 3 being opened.

When the front cover 3 is closed, the protruded parts 501 are simply separated rearward from the engaging parts 99. That is, according to the illustrative embodiment, the process cartridges 8 are not forcibly moved from the separated positions to the contact positions in association with the closing movement of the front cover 3.

<Release Mechanism>

There are two release mechanisms, which are a release mechanism 401 provided at a front left corner inside the housing 2 and another release mechanism 402 provided at a front right corner inside the housing 2 (FIGS. 2-9). It is note that, according to the illustrative embodiment, the releasing mechanisms 401 and 402 are of a conventionally known type and will not be described in detail for brevity.

The left release mechanism 401 has a substantially rectangular block shape and is made of resin as a single piece of member (FIGS. 4 and 8). At an upper end part of the release mechanism 401, a holding mechanism for holding the front cover 3 in an opened state. At a rear end part on the lower surface of the release mechanism 401, a curved surface 401C which curves at a relatively large curvature is formed.

The release mechanism 401 is supported by the frame member 2G, which is arranged at the right front corner inside the housing 2, such that the release mechanism 401 is displaceable in the up-and-down direction (FIGS. 12 and 13). At a central part, in the up-and-down direction, of the release mechanism 401, a recessed part 401G is formed. At least a part of the recessed part 401G is exposed to outside through a cutout 420 formed to the frame member 2G. The recessed part 401G includes an upper inclined surface 401B (FIG. 12) and a lower surface 401C (FIG. 13).

The structure of the right release mechanism 402 is substantially symmetrical with respect to that of the left release mechanism 401 (FIGS. 3 and 8). It is noted, however, the rectangular block shaped resin member 403 is arranged at the lower part of the right release mechanism 402, which is different from the left release mechanism 401.

When the front cover 3 is closed (FIGS. 3 and 5), the protruded part 355 of the second cam 351 is spaced rearward from the curved surface 401C of the left release mechanism 401. In this state, the left release mechanism 401 is configured such that the left positioning protrusion 4M is abutted to the lower periphery 420A of the cutout 420 with the upper inclined surface 401B, thereby the left positioning part 4M being held in position.

When the front cover 3 is closed (FIG. 3), the right release mechanism 402 contacts the resin member 403 from the above, and the resin member 403 contacts the bulged part 3H of the front cover 3 from the above. In this state, the right release mechanism 402 urges the right positioning protrusion 4M of the drawer 4 to contact the lower periphery 420A of the cutout 420 with the upper inclined surface 401B, similarly to the left release mechanism 401 shown in FIG. 12, thereby right positioning protrusion 4M being secured.

With the above configuration, the releasing mechanisms 401 and 402 hold the drawer 4 in a state that the drawer 4 is attached to the main body. It is noted that the positions of the release mechanisms 401 and 402 shown in FIGS. 3-5 and 12 are the holding positions of the release mechanisms 401 and 402.

When the front cover 3 is opened (i.e., moved to the position shown in FIGS. 8 and 9) via the positions shown in FIGS. 6-7, the front cover 3 moves frontward integrally with the protruded part 355 of the second cam 351 and the second cam 351. As a result, the inclined surface of the protruded part 355 slidably contacts the curved surface 401C of the left release mechanism 401 to lift the left release mechanism 401 and support the lower surface of the same from below (FIGS. 6-8). In this state, the release mechanism 401 pushes up the left positioning protrusion 4M of the drawer 4 to a position above the cutout 420 with the lower surface 401C, thereby the holding of the left positioning protrusion 4M being released.

Further, when the front cover 3 is opened (i.e., moved to the position shown in FIGS. 8 and 9) via the positions shown in FIGS. 6-7, the bulged part 3H rotates about the rotation axis X3 and is oriented such that the bulged part 3H bulges on an upper side with respect to the rotation axis X3. Then, the resin member 403 which slidably contacts the bulged part 3H displaced upward, and pushes up the right release mechanism 402 and supports the lower surface of the release mechanism 402 from the below. In this state, similarly to the left release mechanism 401 (FIG. 13), the right release mechanism 402 pushes up the right positioning protrusion 4M of the drawer 4 to a position above the cutout 420 with the lower surface 401C, thereby the holding of the right positioning protrusion 4M being released.

As described above, the release mechanisms 401 and 402 release the holding of the drawer 4 with respect to the main body. FIGS. 8 and 13 show the release positions of the release mechanisms 401 and 402, respectively.

When the front cover 3 is closed after the drawer 4 is attached to the housing 2, the protruded part 355 of the second cam 351 is spaced rearward from the left release mechanism 401, and the resin member 403 which slidably contacts the bulged part 3H displaces downward. As a result, the right and left release mechanisms 401 and 402 displace downward, thereby the right and left positioning protrusions 4M being returned to the holding positions.

According to the image forming apparatus described above, a single link member 500 has the protruded part 501 and the first groove 502.

The protruded part 501 is connected to the first cam 91 of the separation mechanism 90 (FIGS. 2-4 and 9). Specifically, the protruded part 501 is connected to the first cam 91 such that the protruced part 501 is attachable/detachable to the engaging part 99 formed to the first cam 81. When the link member 500 moves in association with the opening movement of the front cover 3, the protruded part 501 pushes the engaging part 99 frontward (FIG. 9). Then, each of the cam portions 96 of the first cam 91, which moves frontward, integrally with the engaging part 99, becomes spaced from the input part 78B of the rocking member 78 of the process cartridge 8. Then, as shown in FIG. 1B, the rocking member 78 rocks and moves the process cartridges 8 to the release positions, which are the spaced positions.

The first groove 502 is connected to the engaging part 359 formed to the second cam 351 of the transmission enable/disable mechanism 350 (FIGS. 2-4 and 9). The first groove 502 pushes the engaging part frontward as the link member 500 moves in association of the opening movement of the front cover 3 (FIGS. 6-9). Then, the sliding part 353 (FIG. 10) of the second cam 351 moves frontward, and the inclined surface 353A and the holding surface 353B slidably contact the flange 303F of the coupling 303, and locate the coupling 303 to the cutoff position.

The protruded part 355 moves frontward integrally with the second cam 351 as the link member 500 moves in association with the opening movement of the front cover 3 (FIGS. 6-9). Then, the protruded part 355 slidably contacts the curved surface 400C and lifts up the left release mechanism 401, which is located to the release position. The right release mechanism 402 is lifted up by the bulged portion 3H and resin member 403 which displace in association with the opening movement of the front cover 3, and located to the release position.

According to the image forming apparatus 1, when the user opens the front cover 3 to remove the process cartridges 8 from the main body, as the single link member 500 moves in association with the opening movement of the front cover 3, the process cartridges 8 are moved to the removable positions, the transmission unit 300 is moved to the cutoff position, and the release mechanism 401 is moved to the release position. Thus, the user does not need to operate the respective components separately.

According to the image forming apparatus 1 described above, it is possible to reduce the number of components and improve the maintenance operation. In particular, according to the illustrative embodiment, a relatively complicated movement in association with the opening movement of the front cover 3 is realized with use of a smaller number of components (i.e., a simple first cam 91, the protruded part 501, the second cam 351, the first groove 502 and the protruded part 355).

According to the image forming apparatus 1, the first groove 502 pushes the engaging part 359 rearward as the link member 500 moves in association with the closing movement of the front cover 3. Then, the sliding part 353 of the second cam 351 returns to its original position, and the inclined surface 353A and the holding surface 353B are spaced from the flange 303F of the coupling 303, thereby the coupling 303 being returned to the transmission position. With this configuration, according to the image forming apparatus 1, it is not necessary for the user to close the front cover 3 and move the transmission unit 300 to the transmission position, separately. Therefore, maintenance operation can be performed relatively easily.

In the foregoing description, the image forming apparatus according to the illustrative embodiment is described. It is noted that the invention should not be limited to the configuration described above, but can be modified in various ways without departing from the scope of the invention.

For example, according to the illustrative embodiment, the spaced positions of the process cartridges 8 are the removable positions. However, the configuration may be modified such that, for example, the contact positions of the developing units may be the removable positions.

According to the illustrative embodiment, the process cartridges 8 are not returned to the original position in association with the closing movement of the front cover 3. However, the configuration may be modified such that contact/separation mechanism may move the developing units from the removable position, which is one of the contact and spaced positions to the original position which is the other of the contact and spaced positions in association with the closing movement of the cover.

According to the illustrative embodiment, the protruded part 355 is formed to the second cam 351 of the transmission enable/disable mechanism 350. This configuration can be modified such that the protruded part may be formed to the link member or the contact/separation mechanism.

According to the illustrative embodiment, when the release mechanisms 401 and 402 are moved from the holding position to the release position, the positioning protrusion 4M of the drawer 4 is lifted. However, the configuration can be modified such that the release mechanisms may move the drawer between the inserted position where the drawer is grasped, and the release position at which the drawer is not lifted or held.

What is claimed is:

1. An image forming apparatus, comprising:

a housing;

an image carrying member arranged inside the housing, the image carrying member being configured such that an electrostatic latent image being formed on the image carrying member;

a developing unit detachably attached inside the housing, the developing unit being configured to supply toner to the image carrying member to develop the electrostatic latent image;

a driving force transmission unit arranged inside the housing and configured to transmit a driving force from a driving source to the image carrying member;

a contact/separation mechanism configured to move the developing unit between a contact position where the developing unit contacts the image carrying member and a separate position where the developing unit is separated from the image carrying member;

a transmission enable/disable mechanism configured to move the driving force transmission unit between a transmission position at which the driving force transmission unit transmits the driving force to the image carrying member and a transmission cutoff position at which the driving force transmission unit does not transmit the driving force to the image carrying member;

a cover movably supported by the housing so as to be opened and closed, the cover being opened when the developing unit is detached from the housing; and a single link member configured to move in association with an opening/closing movement of the cover, the single link member having a first active part connected to the contact/separation mechanism and a second active part connected to the transmission enable/disable mechanism, wherein the first active part acts on the contact/separation mechanism as the link member moves in association with the opening movement of the cover such that the contact/separation mechanism moves the developing unit to a detachable position, which is one of the contact position and the separate position, and at which the developing unit is detachable from the housing, wherein the second active part acts on the transmission enable/disable mechanism as the link member moves in association with the opening movement of the cover such that the transmission enable/disable mechanism moves the driving force transmission unit to the transmission cutoff position, wherein the contact/separation mechanism has a first cam extending in a first direction that is a direction in which the developing unit is moved when attached to or detached from the housing, wherein the first active part has a protruded part which protrudes from the link member and is configured to be contacted to or separated from the first cam in association with displacement of the link member, wherein the transmission enable/disable mechanism has a second cam extending in the first direction, and wherein the second active part has a guide groove which is formed on the link member and configured to guide the movement of the second cam.

2. The image forming apparatus according to claim 1, wherein the second active part acts on the transmission enable/disable mechanism as the link member moves in association with the closing movement of the cover such that the transmission enable/disable mechanism moves the driving force transmission unit to the transmission position.

3. An image forming apparatus, comprising a housing;

an image carrying member arranged inside the housing, the image carrying member being configured such that an electrostatic latent image being formed on the image carrying member;

a developing unit detachably attached inside the housing, the developing unit being configured to supply toner to the image carrying member to develop the electrostatic latent image;

a driving force transmission unit arranged inside the housing and configured to transmit a driving force from a driving source to the image carrying member;

a contact/separation mechanism configured to move the developing unit between a contact position where the developing unit contacts the image carrying member and a separate position where the developing unit is separated from the image carrying member;

a transmission enable/disable mechanism configured to move the driving force transmission unit between a transmission position at which the driving force transmission unit transmits the driving force to the image carrying member and a transmission cutoff position at which the driving force transmission unit does not transmit the driving force to the image carrying member;

a cover movably supported by the housing so as to be opened and closed, the cover being opened when the developing unit is detached from the housing:

a single link member configured to move in association with an opening/closing movement of the cover, the single link member having a first active part connected to the contact/separation mechanism and a second active part connected to the transmission enable/disable mechanism;

a drawer configured to be inserted into and drawn from the housing, the drawer holding the developing unit; and a release mechanism configured to move between a holding position at which the drawer is held at an inserted position and a release position at which holding of the drawer at the inserted position is released, wherein the first active part acts on the contact/separation mechanism as the link member moves in association with the opening movement of the cover such that the contact/separation mechanism moves the developing unit to a detachable position, which is one of the contact position and the separate position, and at which the developing unit is detachable from the housing, wherein the second active part acts on the transmission enable/disable mechanism as the link member moves in association with the opening movement of the cover such that the transmission enable/disable mechanism moves the driving force transmission unit to the transmission cutoff position, and wherein one of the link member, the contact/separation mechanism and the transmission enable/disable mechanism has a third active part which is configured to act on the release mechanism as the link member moves in association with the opening movement of the cover such that the release mechanism is moved to the release position.

4. The image forming apparatus according to claim 3, wherein:

the transmission enable/disable mechanism has a second cam extending in a first direction that is a direction in which the developing unit is moved when attached to or detached from the housing; and the third active part has a protruded part which protrudes from the second cam and is contacted to or separated from the release mechanism in association with displacement of the second cam.

5. The image forming apparatus according to claim 3, wherein the second active part acts on the transmission enable/disable mechanism as the link member moves in association with the closing movement of the cover such that the transmission enable/disable mechanism moves the driving force transmission unit to the transmission position.

* * * * *